US005465972A

United States Patent [19]

Cornett

[11] Patent Number: 5,465,972

[45] Date of Patent: Nov. 14, 1995

[54] GOLF PUTTING AID

[76] Inventor: Jerry W. Cornett, P.O. Box 1242, Seminole, Tex. 79360

[21] Appl. No.: 378,834

[22] Filed: Jan. 26, 1995

[51] Int. Cl.[6] ..... A63B 69/36

[52] U.S. Cl. ..... 273/186.3

[58] Field of Search ..... 273/183.1, 186.1, 273/186.2, 186.3, 187.4

[56] References Cited

U.S. PATENT DOCUMENTS

| | | | |
|---|---|---|---|
| 3,070,373 | 12/1962 | Mathews et al. | 273/187.4 X |
| 3,953,034 | 4/1976 | Nelson | 273/186.3 |
| 4,456,257 | 6/1984 | Perkins | 273/186 |
| 4,949,971 | 8/1990 | Thornton | 273/186.2 |
| 4,997,189 | 3/1991 | Perkins | 273/186.2 X |
| 5,165,691 | 11/1992 | Cook | 273/186 |
| 5,169,150 | 12/1992 | Tindale | 273/187.4 |
| 5,193,812 | 3/1993 | Hendricksen | 273/186.3 |
| 5,207,429 | 5/1993 | Walmsley | 273/186.2 |
| 5,213,331 | 5/1993 | Avanzini | 273/186.3 |
| 5,217,228 | 6/1993 | De Aguilar | 273/186.3 |
| 5,374,063 | 12/1994 | Ogden | 273/186.3 |

*Primary Examiner*—William H. Grieb
*Attorney, Agent, or Firm*—Wendell Coffee

[57] ABSTRACT

A laser sighting unit is attached to a putter or a wedge. The laser sighting unit includes a clamp which attaches an adjustable bracket and a laser unit to the shaft of a golf club. The laser unit is activated by a switch that is removably attached to the handle of the golf club. The laser sighting unit can be attached or removed from a golf club without any alterations to the golf club, and without the aid of tools. The laser sighting unit is used to aid a golfer in obtaining proper alignment of the golf club before the golf ball is hit.

16 Claims, 3 Drawing Sheets

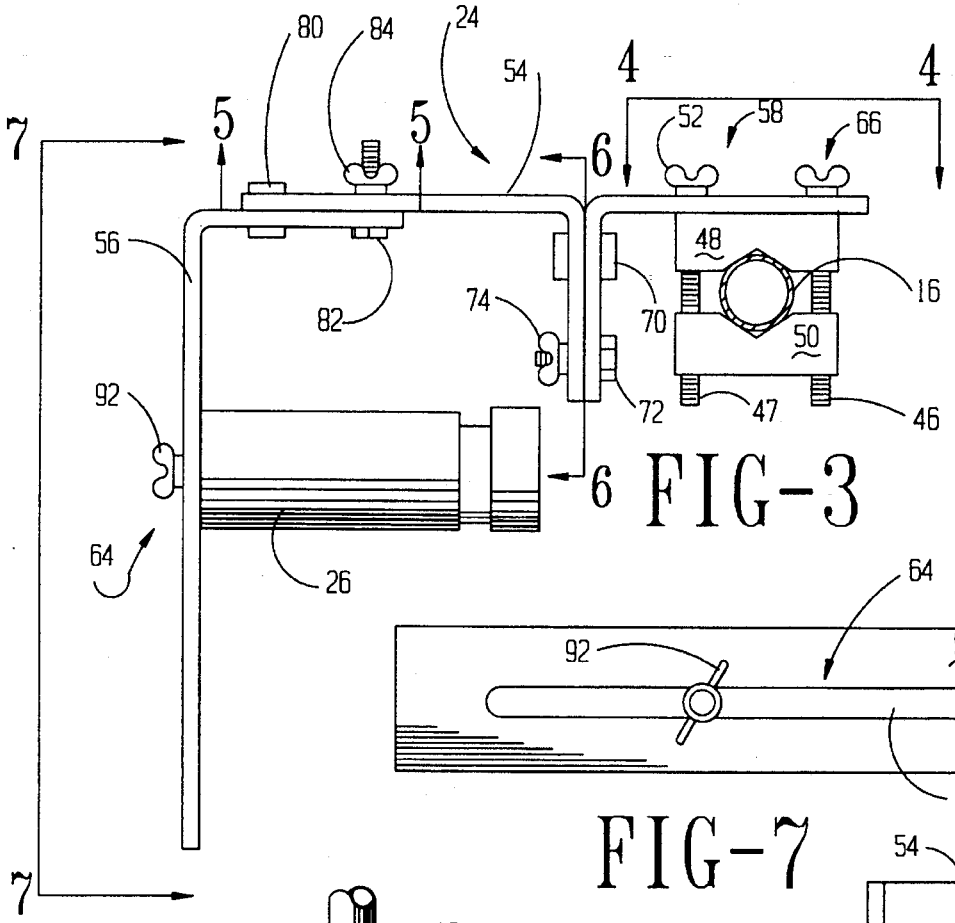
FIG-3
FIG-7
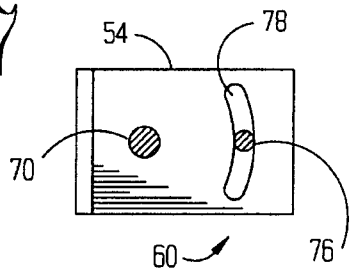
FIG-6
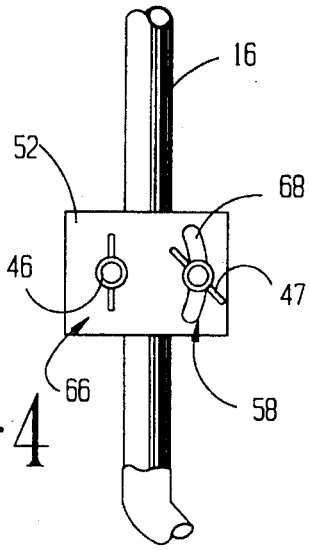
FIG-4
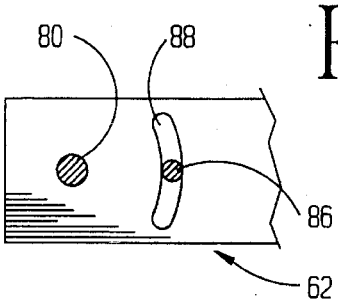
FIG-5

GOLF PUTTING AID

CROSS REFERENCE TO RELATED APPLICATION

None, however, Applicant filed Disclosure Document Number 362905 on Oct. 11, 1994, which document concerns this application; therefore, by separate paper it is respectfully requested that the document be retained and acknowledgment thereof made by the Examiner. (MoPEP 1706)

BACKGROUND OF THE INVENTION

1. Field of the Invention

This invention relates to a golf training device, and more particularly to a removable laser sighting device attached to a golf club that aids in attaining proper alignment of a golfer's club swing. The device can be used on putters or wedges.

Golfers have ordinary skill in the art.

2. Description of related art

One problem that many golfers face is inaccurate alignment of the golf club striking surface with a target at the time of impact of the golf club with the golf ball. This causes the golf ball to go in a path that the golfer did not intend. Alignment problems are particularly troublesome in the putting and chipping portions of the game of golf.

The direction a golf ball travels after the ball is hit depends on many factors including the area of contact of the club on the ball, and the angle of the ball striking surface of the club in relation to the golf ball at the moment of contact. Most golfers prefer to hit a golf ball so that the golf ball travels perpendicular to the ball striking surface of the golf club towards a selected target. If a golf ball is not hit so that the ball will travel perpendicular to the ball striking surface, other corrections will have to be made to the stroke to compensate.

Many prior art devices exist for improving a golfer's putting game. These include practice holes or cups, target devices for the holes, and pieces of carpet that simulate putting greens. There are also prior art optical devices that visually indicate the proper alignment of a golfer's stroke.

Most of the prior art devices only try to correct problems with the putting game, and do not attempt to train a golfer to better the golfer's chipping game. A major disadvantage to many of the prior art optical devices is that the devices require special training clubs equipped with optical devices, or else require permanent modifications to be made to the training clubs. Such clubs cannot be used in tournament play.

SUMMARY OF THE INVENTION (1) Progressive contribution to the art

I have invented a device for aiding a golfer in obtaining better alignment in the golfer's stroke in putting or chipping. The device attaches to a putter or to a wedge. The device includes an adjustable bracket attached to the golf club's shaft, a laser unit mounted to the bracket, and a switch for the laser unit attached to the golf club's handle. The laser unit is adjusted so that when the switch is activated, a laser beam from the laser unit passes over a golf ball and onto a ground surface in front of the golf ball. The beam points in a direction that indicates the direction of initial travel of a golf ball if the ball is hit properly. After the ball has been hit, any deviation from the proper direction of travel will indicate to the user that an adjustment needs to be made to the golfer's stroke.

The device is attachable to a regular golf club without the aid of any tools. Most golfers do not carry tools such as pliers or screwdrivers. Also, the device can be removed from the golf club without the aid of any tools. This device enables a golfer to practice; and then, after the device has been removed from the golf club, the golfer can play a round of golf using the same club that the golfer used to practice with.

(2) Objects of this invention

An object of this invention is to provide a laser sighting unit for a golf club to aid a golfer in properly aligning the golfer's stroke.

A further object of this invention is to provide a laser sighting unit for either a putter or a wedge.

A further object of this invention is to provide a laser sighting unit that is easily removable from the golf club, without the use of any tools.

Further objects are to achieve the above with a device which is sturdy, compact, durable, light-weight, simple, safe, efficient, versatile, ecologically compatible, energy conserving and reliable, yet inexpensive and easy to manufacture, install, and maintain.

Other objects are to achieve the above with a method that is rapid, versatile, ecologically compatible, energy conserving, efficient, inexpensive, and does not require highly skilled people or tools to install and maintain.

The specific nature of the invention, as well as other objects, uses, and advantages thereof, will clearly appear from the following description and from the accompanying drawings, the different views of which are not necessarily scale drawings.

BRIEF DESCRIPTION OF THE DRAWINGS

FIG. 3 is a sectional view of the first embodiment taken substantially along line 3—3 of FIG. 1 showing the connection of the clamp and bracket to the golf club.

FIG. 4 is a back elevational view of the first embodiment taken substantially along line 4—4 of FIG. 3.

FIG. 5 ms a sectional view taken substantially along line 5—5 of FIG. 3.

FIG. 6 is a sectional view taken substantially along line 6—6 of FIG. 3.

FIG. 7 is a side elevational view of the first embodiment taken substantially along line 7—7 of FIG. 3.

Figure 2:
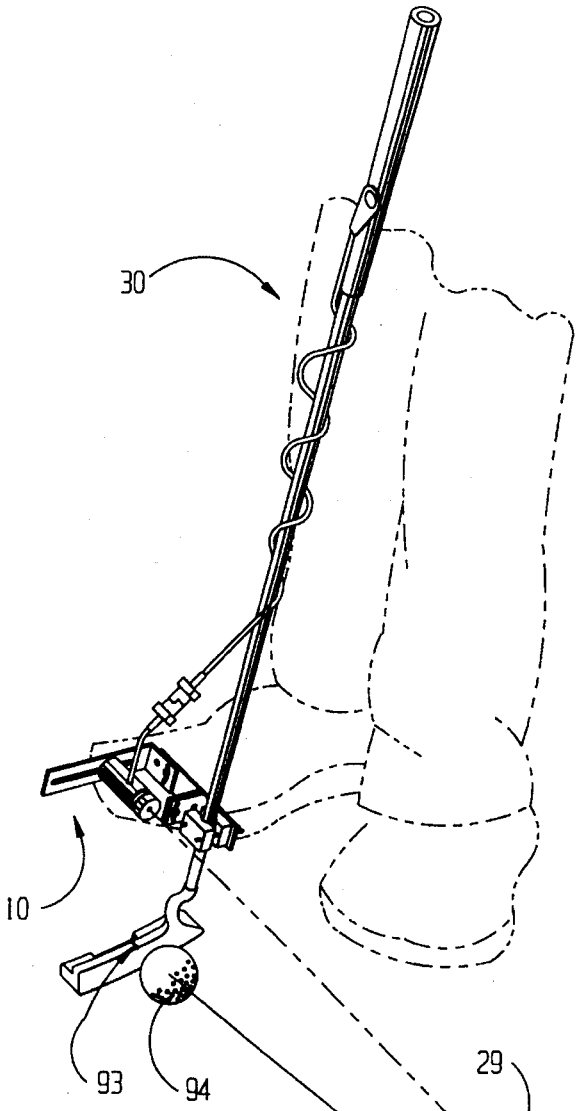
FIG. 2 is a perspective view of the embodiment shown in FIG. 1 showing it in use with a cup for practice.
Figure 1:
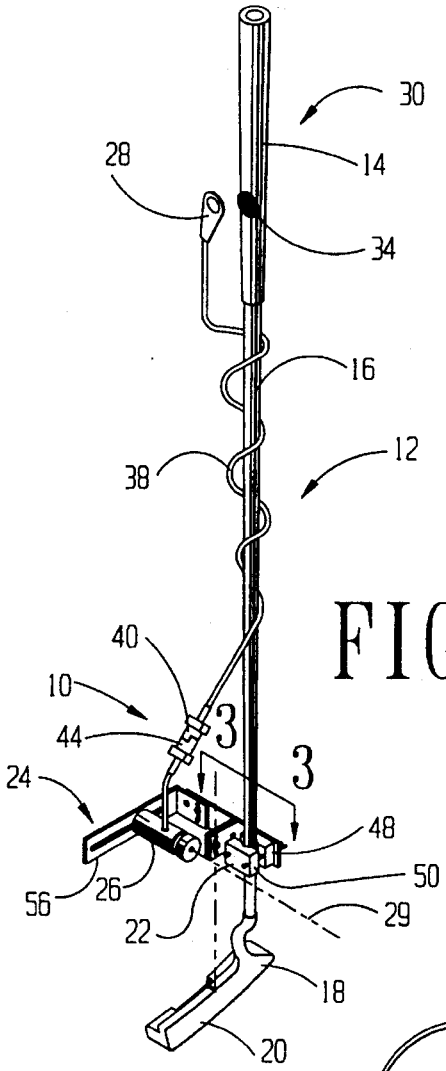
FIG. 1 is a perspective view of a first embodiment of the invention in connection with a putter.

As an aid to correlating the terms of the claims to the exemplary drawings the following catalogue of elements and steps is provided:

10 laser sighting unit
12 golf club
14 handle
16 shaft
18 club head
20 planar ball striking surface
22 clamp
24 adjustable bracket
29 laser unit
28 switch
29 laser beam
30 putter
32 wedge
34 first VELCRO pad
36 second VELCRO pad
38 wiring
40 inline connector
42 battery charger
44 laser unit end
46 wing bolt
47 wing bolt
48 first block
50 second block
52 first angle
54 second angle
56 third angle
58 vertical height adjuster
60 parallel adjuster
62 beam distance adjuster
64 centering adjuster
66 pivot
68 arcuate slot
70 rivet
72 bolt
74 wing nut
76 hole
78 arcuate slot
80 rivet
82 bolt
84 wing nut
86 hole
88 arcuate slot
90 slot
92 wing bolt
93 sweet spot
94 golf ball
96 parallel lines
98 wedge angle
102 beam distance adjuster
104 hole
106 wing bolt

DESCRIPTION OF THE PREFERRED EMBODIMENTS

With reference to the drawings, a laser sighting unit is designated generally as 10. The laser sighting unit is used as a training aid for helping a golfer practice putting or chipping. The laser sighting unit attaches to golf club 12. A golf club has handle 14, shaft 16, and club head 18. The club head has planar ball striking surface 20.

The laser sighting unit 10 includes clamp 22 which attaches to the shaft 16 of the golf club 12; adjustable bracket 24 which attaches to the clamp; laser unit 26 which attaches to the bracket; and switch 28 which activates the laser unit. The laser unit should be light weight, and should produce laser beam 29 which is visible in daylight. The laser sighting unit can be attached to putter 30, as shown in FIG. 2; or to wedge 32, as shown in FIG. 7.

Figure 12:
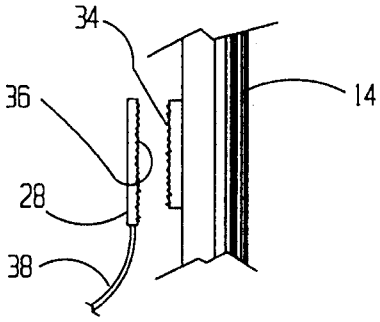
FIG. 12 is a side elevational view of the handle of the golf club and the laser unit switch.

The laser unit's switch 28 is attached to handle 14 of the golf club 12. First VELCRO pad 34 is attached to the handle, preferably by an adhesive. Second VELCRO pad 36 on the back of the laser unit switch is attached to the first pad by pressing the two pads together. (FIG. 12)

Figure 11:
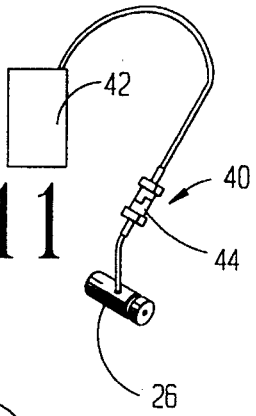
FIG. 11 is a schematic representation of a recharger connected to the laser unit.
Figure 8:
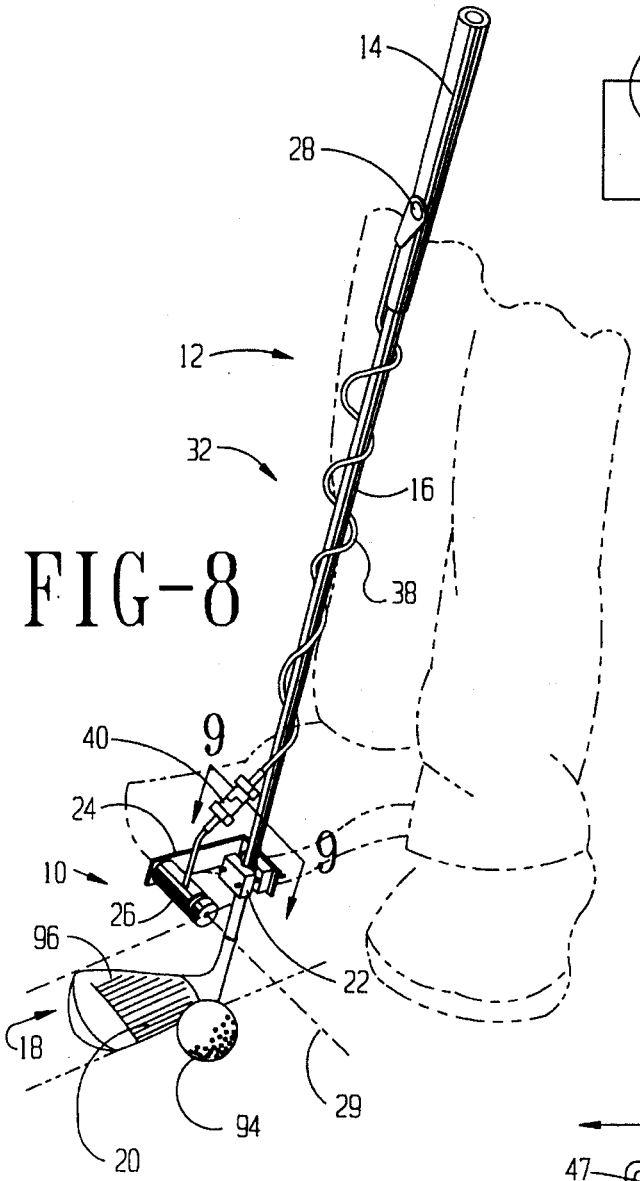
FIG. 8 is a perspective view of a second embodiment of the invention shown mounted on a wedge.
Figure 10:
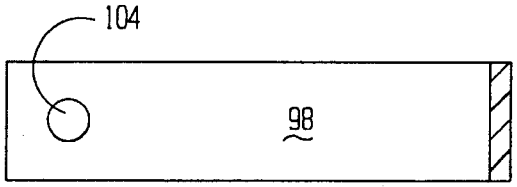
FIG. 10 is a sectional view taken substantially along line 10—10 of FIG. 9.

Wiring 38 extends from the switch 28 to the laser unit 26. Inline connector 40 is located in the wiring between the switch and the laser unit. When the inline connector is disconnected, a battery charger 42 can be attached to laser unit end 44 of the inline connector to recharge the laser unit. (FIG. 11) The battery charger can operate from a standard wall socket (not shown), or the battery charger can use a standard 9 volt battery (not shown) to recharge the laser unit. To keep the wiring out of the golfer's way, the wiring can be wrapped about the shaft 16 of the golf club 12 before the wiring is connected at the inline connector.

The clamp 22 that attaches the bracket 24 and laser unit 26 to the golf club 12 comprises a pair of v-notched blocks that are joined together by unassisted manual operation with a pair of hand operable bolts 46, 47. Wing bolts are the preferred type of bolt to be used. The v-notched blocks are preferably made of aluminum. The first block 48 has two holes, one on either side of the v-notch, through which passes a shank of a wing bolt. The second block 50 has corresponding threaded holes. One of the wing bolts 46 is passed through the bracket and the first block, and is threaded to the second block. The v-notches of the blocks are positioned on opposite sides of the shaft 16 of the golf club, and the other wing bolt 47 is used to secure the two blocks together. Both wing bolts are tightened to secure the clamp about the shaft of the golf club.

FIG. 3 shows the bracket attached to a putter. For a putter 30, the bracket 24 includes first angle 52, second angle 54, and third angle 56. The angles are preferable made of a plastic material, such as polycarbonate. The angles allow there to be vertical height adjuster 58, parallel adjuster 60, beam distance adjuster 62, and centering adjuster 64.

First angle 52 attaches to the clamp 22 by the wing bolts 46, 47. One wing bolt acts as pivot 66, and arcuate slot 68 in the first angle allows for minor height adjustments to be made about the second wing bolt. This connection forms the vertical height adjuster 58. Major height adjustments can be made by moving the clamp up or down the shaft 16.

First angle 52 is connected to second angle 54 by rivet 70, and also by bolt 72 and hand operable nut 74. Wing nuts are the preferred type of nut to be used on the laser sighting unit 10. The wing nut 74 is attached to the bolt through hole 76 and arcuate slot 78. This connection forms the parallel adjuster 60. The rivet is a pivot, and the slot allows for adjustment so that angle three 56 will be parallel to the putter head 18. The parallel adjuster is needed because the shaft of a putter is not at a right angle to the putter head.

Second angle 54 is connected to third angle 56 by rivet 80, and also by bolt 82 and wing nut 84 attached through hole 86 and arcuate slot 88. This connection forms the beam distance adjuster 62. The rivet is a pivot, and the slot allows for adjustment of the distance that the laser beam 29 will shine in front of the putter 30.

Third angle 56 also has slot 90. The laser unit 26 attaches to the bracket 24 by wing bolt 92 through the slot. The slot is the centering adjuster 64. The slot allows the laser unit to be placed over the sweet spot 93 of the putter head 18. The sweet spot is the spot on the putter head where the putter head should make contact with golf ball 94.

The laser sighting unit 10 is adjusted so that third angle 56 is parallel to the putter head 18. The laser unit 26 is positioned over the sweet spot 93 of the putter head. Two lines that perpendicularly intersect are used to adjust the laser sighting unit. The edge of the ball striking surface 20 of the putter 30 is placed on one of the lines such that the sweet spot of the putter is above the intersection of the two lines. The laser unit is activated, and if the beam does not shine on the perpendicular line, an adjustment is made by rotating the bracket 24 at the clamp 22 until the beam shines along the perpendicular line. Then, the distance from the putter to the spot where the laser beam 29 touches the ground can be adjusted with the beam distance adjuster 62.

Figure 9:
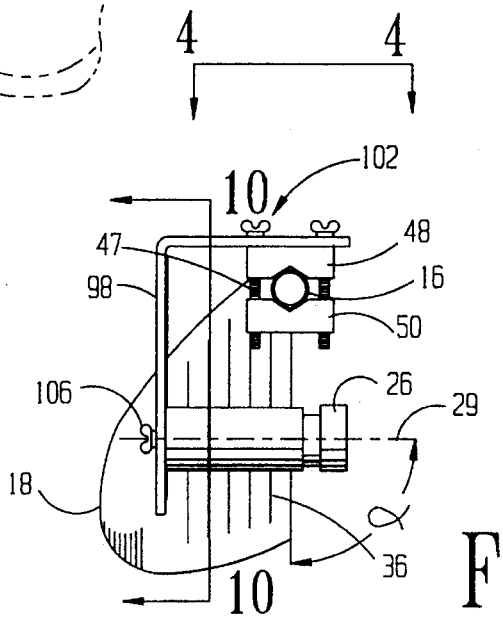
FIG. 9 is a sectional view taken substantially along line 9—9 of FIG. 8.

FIG. 9 shows the bracket 24 attached to a wedge 32. The wedge can be a sand wedge or a pitching wedge. A wedge is used for chipping. The club head 18 of a wedge has parallel lines 96 inscribed on the ball striking surface 20.

The bracket 24 used on a wedge 32 must be sturdier than the bracket used on a putter 30 because of the force applied to the club when using a wedge. A person using a putter should only hit the ball striking surface of the putter against the golf ball. A person using a wedge often hits the ground with the club as well as the golf ball. The bracket for a wedge should be made of a metal, preferably aluminum. Also, the bracket does not have to be as adjustable as the bracket for a putter. This is because chipping does not require as much accuracy as does putting, therefore, a golfer will only need to know in general that alignment is proper.

For a wedge 32, the bracket 24 comprises wedge angle 98. The wedge angle attaches to the clamp 22 by the wing bolts 46, 47. One wing bolt acts as a pivot 66, and arcuate slot 68 in the wedge angle allows the user to adjust the distance that a laser beam 29 from the laser unit 26 will shine in front of the wedge. This forms beam distance adjuster 102. The laser unit attaches to the bracket at hole 104, by wing bolt 106.

Two lines that perpendicularly intersect are used to align the laser sighting unit 10. The parallel lines 96 inscribed on the club are placed parallel to one of the perpendicular lines. Then, the laser unit 26 is activated, and if the laser beam 29 does not land on the perpendicular line, an adjustment is made by rotating the bracket 24 and clamp 22 about the shaft 16 of the wedge 32. Angle $\alpha$, as shown in FIG. 9 will be 90° for most golfers.

To use the laser sighting system 10, the laser sighting system is attached to the golf club 12. Attachment requires no tools (i.e., manually unassisted) because the laser sighting system is attached to a golf club by wing bolts, and by VELCRO. After attachment, the laser sighting system is adjusted as described above.

The user addresses a golf ball 94 and activates the laser unit 26 by pressing the switch 28. The laser beam 29 will point in the direction where a golf ball 94 would travel if the golf ball is hit properly and there is no slope of the ground surface. The user should make a mental note of where the laser beam points. Then, the user hits the golf ball. If there is a deviation between where the golf ball actually went and where it should have gone as indicated by the laser beam, a correction can be made to the golfer's stroke.

After the golfer is satisfied with the golfer's practice game, the golfer can remove the laser sighting device 10. This is accomplished by removing the switch 28 from the handle 14, and by removing the clamp 22 from the shaft 16. The clamp is removed by unscrewing the wing bolts 46 from the second block 50. Removal of the laser sighting device from the club 12 can be accomplished manually unassisted, i.e., without the aid of any tools.

The embodiments shown and described above are only exemplary. I do not claim to have invented all the parts, elements, or steps described. Various modifications can be made in the construction, material, arrangement, and operation, and still be within the scope of my invention.

The restrictive description and drawings of the specific examples above do not point out what an infringement of this patent would be, but are to enable one skilled in the art to make and use the invention. The limits of the invention and the bounds of the patent protection are measured by and defined in the following claims.

I claim as my invention:

1. A method of practicing a golf stroke comprising:

a) removably attaching a switch to a handle of a golf club by unassisted manual operation;

b) attaching a laser unit to a shaft of the golf club by unassisted manual operation;

c) connecting the switch to the laser unit;

d) adjusting the laser unit so that a laser beam points onto a ground surface in an optimum direction with respect to a ball striking surface of the golf club;

e) placing the ball striking surface of the golf club adjacent to a golf ball, f) activating the switch to produce a laser beam, g) adjusting the position of the golf club so that the laser beam is aligned with a target;

h) swinging the club, thereby i) hitting the golf ball with the ball striking surface; and j) repeating steps e through i until satisfied with both consistency and result.

2. A method of practicing a golf stroke as defined in claim 1 further comprising:

k) removing the switch from the handle by unassisted manual operation;

l) removing the laser unit from the shaft by unassisted manual operation; and m) using the golf club in regular play.

3. A method of practicing a golf stroke as defined in claim 1 further comprising:

k) disconnecting the switch from the laser unit;

l) connecting a battery charger to the laser unit;

m) charging the laser unit; and n) reattaching the switch to the laser unit.

4. A golf club with removable laser sighting, comprising:

a) a shaft;

b) a handle at a top end of the shaft;

c) a club head affixed to a lower end of the shaft, d) said club head having a planar ball striking surface;

e) a clamp removably attached to the shaft;

f) an adjustable bracket attached to the clamp;

g) a laser unit adjustably mounted on the bracket so that a laser beam from the laser unit passes over a golf ball and onto a ground surface; and h) a switch for the laser unit attached to the handle of the club by synthetic materials which adhere when pressed together.

5. A golf club with removable laser sighting as defined in claim 4 wherein the clamp comprises:

i) a pair of v-notched blocks about the shaft; and j) a means for connecting the blocks, said means being hand operable without the need for additional tools.

6. A golf club with removable laser sighting as defined in claim 4 wherein:

i) a first portion of synthetic material is attached to the handle of the golf club; and j) a second portion of synthetic material is on a backside of the switch, k) said first portion of synthetic material connects to said second portion of synthetic material when pressed together.

7. A golf club with removable laser sighting as defined in claim 4 wherein the golf club is a putter.

8. A golf club with removable laser sighting as defined in claim 7 wherein the bracket is made of plastic.

9. A golf club with removable laser sighting as defined in claim 7 with the adjustable bracket having:

i) a centering adjuster for centering the laser unit above the club head;

j) a beam distance adjuster for adjusting where a laser beam from the laser unit will touch the ground in front of a golf ball;

k) a parallel adjuster for aligning the centering adjuster parallel to the ball striking surface; and l) a vertical height adjuster for making minor height corrections.

10. A golf club with removable laser sighting as defined in claim 9 wherein said adjustable bracket includes:

m) a first angle having a hole and an arcuate slot, n) a pair of hand operable attachment means that connect the first angle to the clamp, o) one of said attachment means and the hole to form a pivot, and p) the other attachment means and the slot form the vertical height adjuster;

q) a pivot rivet connecting the first angle to a second angle, r) a bolt, and s) a hand operable nut connected through t) a corresponding hole and arcuate slot in the first angle and second angle to form the parallel adjuster;

u) a pivot rivet connecting the second angle to a third angle, v) a bolt, and w) a hand operable nut connected through x) a corresponding hole and arcuate slot in the second angle and the third angle to form the beam distance adjuster; and y) a slot in the third angle through which z) a hand operable adjustable bolt passes and connects to the laser unit to form the centering adjuster.

11. A golf club with removable laser sighting as defined in claim 4 wherein the golf club is a wedge.

12. A golf club with removable laser sighting as defined in claim 11 wherein the bracket is made of a metal.

13. A golf club with removable laser sighting as defined in claim 11 wherein the bracket comprises:

i) a beam distance adjuster attached to the laser unit.

14. A golf club with removable laser sighting as defined in claim 13 wherein the beam distance adjuster comprises:

j) a wedge angle having a hole and an arcuate slot, and k) a pair of hand operable attachment means that connect the wedge angle to the clamp, l) one of said attachment means and the hole forming a pivot, and m) the other attachment means and the slot form the beam distance adjuster.

15. A removable laser sighting system adapted to be attached to a golf club, said golf club having:

a) a shaft;

b) a handle at a top end of the shaft;

c) a club head affixed to a lower end of the shaft, and d) said club head having a planar ball striking surface, said laser sighting system comprising:

e) a clamp removably attachable to the shaft;

f) an adjustable bracket attached to the clamp;

g) a laser unit adjustably mounted on the bracket so that a laser beam from the laser unit may be adjusted to pass over a golf ball and onto a ground surface when the laser sighting system is attached to the golf club; and h) a switch connected to the laser sighting unit attachable to the handle of the club by synthetic materials which adhere when pressed together.

16. A removable laser sighting system as defined in claim 15 further comprising:

i) an inline connecter between the laser and the switch so that j) a battery charger may be removably attached to the laser unit by the inline connecter.

* * * * *